US009439544B1

(12) United States Patent
DeCarlo

(10) Patent No.: US 9,439,544 B1
(45) Date of Patent: Sep. 13, 2016

(54) TOILET STOOL TABLE ASSEMBLY

(71) Applicant: Anthony J. DeCarlo, Bakersfield, CA (US)

(72) Inventor: Anthony J. DeCarlo, Bakersfield, CA (US)

( * ) Notice: Subject to any disclaimer, the term of this patent is extended or adjusted under 35 U.S.C. 154(b) by 230 days.

(21) Appl. No.: 14/168,763

(22) Filed: Jan. 30, 2014

(51) Int. Cl.
*E03D 11/00* (2006.01)
*A47K 17/02* (2006.01)

(52) U.S. Cl.
CPC ..... *A47K 17/02* (2013.01); *E03D 11/00* (2013.01)

(58) Field of Classification Search
CPC ..... A47K 17/026
USPC ..... 4/254; 5/2.1; 312/235.9; D06/396; D19/75; 297/135; 108/50.11
See application file for complete search history.

(56) References Cited

U.S. PATENT DOCUMENTS 1,862,237 A * 6/1932 Pepler ..... A47B 23/02 108/140
1,925,246 A * 9/1933 Hayes ..... A47C 4/283 297/162
2,243,264 A * 5/1941 Stromblad ..... A47K 17/028 4/254
2,461,715 A * 2/1949 Biggerstaff ..... A47D 3/005 108/137
2,703,265 A * 3/1955 Wolfe ..... A47B 23/02 108/49
2,773,542 A * 12/1956 Chasin ..... A47K 17/026 297/411.36
2,994,366 A * 8/1961 Hoch ..... A47C 7/70 108/6
3,090,051 A * 5/1963 Oakland ..... A47K 17/026 4/254
3,174,162 A * 3/1965 Sinton ..... H05B 3/342 248/240.4
3,209,375 A * 10/1965 Parsons ..... A47K 17/02 331/108 R
3,245,090 A * 4/1966 Slimmer ..... A61G 5/1002 297/188.08
3,265,436 A * 8/1966 La Bombard ..... A47C 7/70 297/150
3,392,411 A * 7/1968 Hansen ..... A47K 13/005 297/35
3,398,410 A * 8/1968 Sparling ..... A47K 17/022 4/254
3,405,411 A * 10/1968 Brown ..... A47K 17/026 4/254
3,474,471 A * 10/1969 Matibag ..... A47K 17/022 297/411.32
3,574,242 A * 4/1971 Trowbridge ..... A47K 17/026 4/254
3,586,367 A * 6/1971 Cincotta ..... A47C 7/68 297/162
3,717,375 A * 2/1973 Slobodan ..... A47B 83/02 297/154
4,196,480 A * 4/1980 Guenther ..... A47K 17/026 297/411.32

(Continued)

FOREIGN PATENT DOCUMENTS

GB 148478 2/1921
KR 1020120131412 12/2012

(Continued)

*Primary Examiner* — Lori Baker

(57) ABSTRACT

A toilet stool table assembly provides a table for a user seated on a toilet seat. The assembly includes a toilet having a base and a toilet bowl being attached to and positioned on the base. The toilet bowl has an upper edge, a front side, a rear side, a first side and a second side. The first and second sides are coupled to and extend between the front and rear sides. A first arm is coupled to the first side of the toilet bowl and extends along the first side of the toilet bowl. The first arm has a first end spaced from a second end. Each of the first and second ends of the first arm is coupled to the first side of the toilet bowl. A panel is coupled to the first arm.

20 Claims, 7 Drawing Sheets

(56) References Cited

U.S. PATENT DOCUMENTS 4,300,798 A * 11/1981 Musgrove ..... A47C 7/68 297/162
4,343,052 A * 8/1982 Guenther ..... A47K 17/026 297/411.23
4,602,759 A * 7/1986 Webber ..... A47B 97/00 211/133.1
4,715,069 A * 12/1987 James ..... A47K 17/026 4/254
4,787,102 A * 11/1988 Rosenberg ..... A61G 9/00 4/254
4,878,685 A * 11/1989 Bahm ..... A61G 5/10 108/90
4,894,871 A * 1/1990 Schmerler ..... A47L 17/026 135/67
4,924,531 A * 5/1990 Square ..... A47K 17/022 297/DIG. 10
5,215,353 A * 6/1993 Daniel ..... A47C 7/54 297/411.2
5,329,645 A * 7/1994 Fossum ..... A47K 17/024 4/254
5,603,267 A * 2/1997 Soper ..... A47B 3/00 108/116
5,621,927 A * 4/1997 Reiss ..... A47K 3/004 248/206.4
5,687,431 A * 11/1997 Garrett ..... A47K 17/02 4/237
5,761,753 A * 6/1998 Talbert ..... A47K 3/004 281/45
5,787,515 A * 8/1998 Mason ..... A47K 17/026 297/217.7
5,820,152 A * 10/1998 Warren-Pfaeffle ... A47K 17/026 280/250.1
5,832,542 A * 11/1998 Dominguez ..... A47K 17/026 4/254
5,873,624 A * 2/1999 Simpson ..... A47C 7/70 297/173
5,878,893 A * 3/1999 Micienko ..... A47K 10/38 211/13.1
6,032,586 A * 3/2000 Reyes ..... A47B 23/041 108/25
6,148,448 A * 11/2000 Urso ..... A47K 17/026 297/423.4
6,212,695 B1 * 4/2001 Arduini ..... A47K 17/026 4/254
6,324,705 B1 * 12/2001 Zephier ..... A47K 17/02 4/254
6,364,411 B1 * 4/2002 Zheng ..... A47C 7/62 297/135
6,418,567 B1 * 7/2002 Brinkman ..... A47K 17/026 297/411.3
6,899,386 B2 * 5/2005 Anton ..... A47C 7/68 297/170
6,904,622 B1 * 6/2005 Gabriel ..... A47K 17/026 4/237
6,983,493 B1 * 1/2006 Shaumyan ..... A47K 17/022 4/254
7,100,977 B2 * 9/2006 Burwell ..... A47C 7/70 297/170
D555,950 S 11/2007 Hart
D582,710 S 12/2008 Perlman
7,748,064 B2 * 7/2010 Hamilton ..... A47C 16/00 248/118
7,900,566 B1 * 3/2011 Bunker ..... A47C 7/68 108/167
8,978,171 B1 * 3/2015 Wise ..... A47K 13/24 4/254
2010/0251469 A1 * 10/2010 Kim ..... A47K 17/024 4/254

FOREIGN PATENT DOCUMENTS

WO WO 9841136 A2 * 9/1998 ..... A47K 17/026
WO WO2011063399 9/2011

* cited by examiner

TOILET STOOL TABLE ASSEMBLY

BACKGROUND OF THE DISCLOSURE

Field of the Disclosure

The disclosure relates to table devices and more particularly pertains to a new table device for providing a table for a user seated on a toilet seat.

SUMMARY OF THE DISCLOSURE

An embodiment of the disclosure meets the needs presented above by generally comprising a toilet having a base and a toilet bowl being attached to and positioned on the base. The toilet bowl has an upper edge, a front side, a rear side, a first side and a second side. The first and second sides are coupled to and extend between the front and rear sides. A first arm is coupled to the first side of the toilet bowl and extends along the first side of the toilet bowl. The first arm has a first end spaced from a second end. Each of the first and second ends of the first arm is coupled to the first side of the toilet bowl. A panel is coupled to the first arm.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
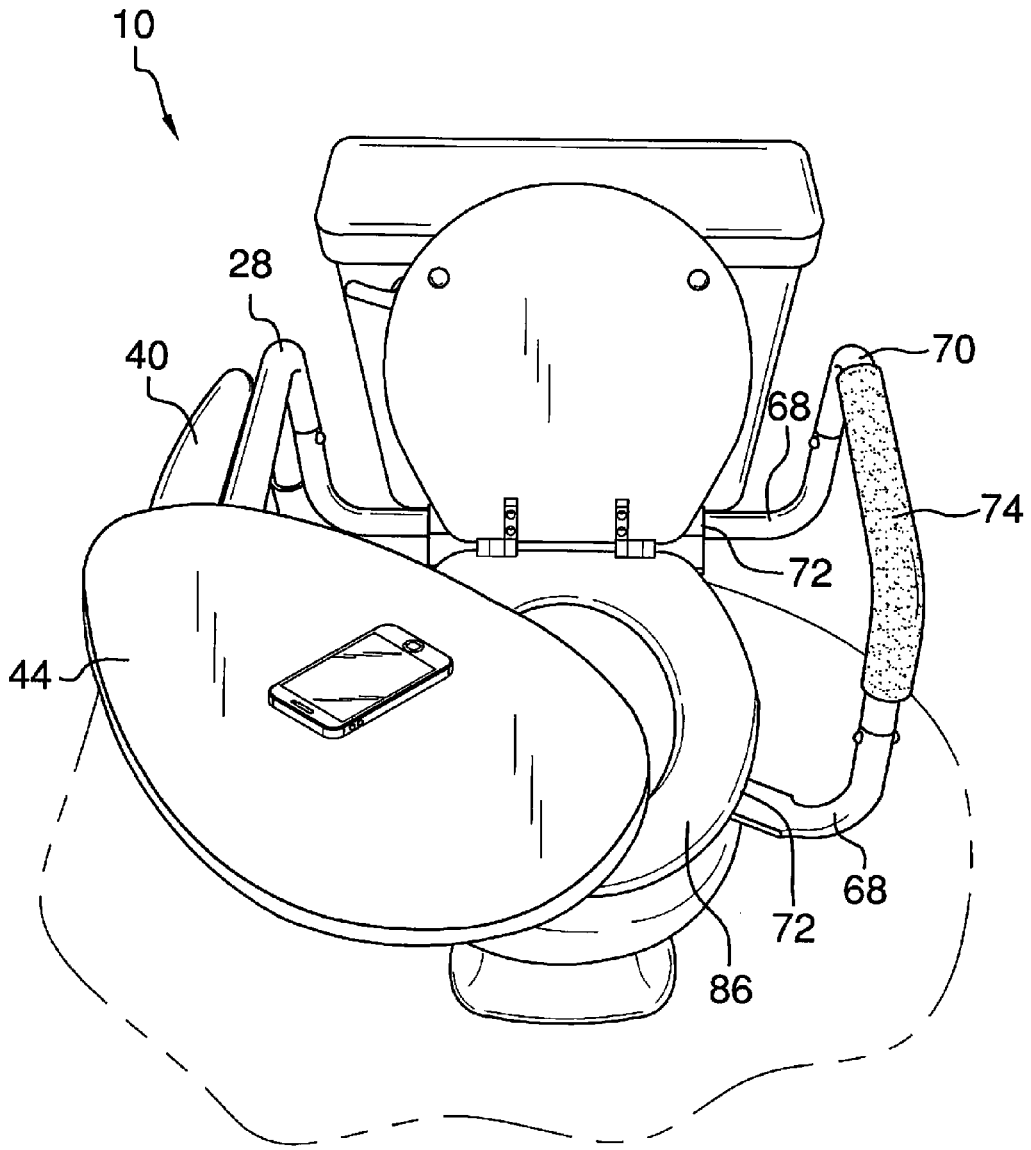
FIG. 1 is a top front perspective view of a toilet stool table assembly according to an embodiment of the disclosure.
Figure 2:
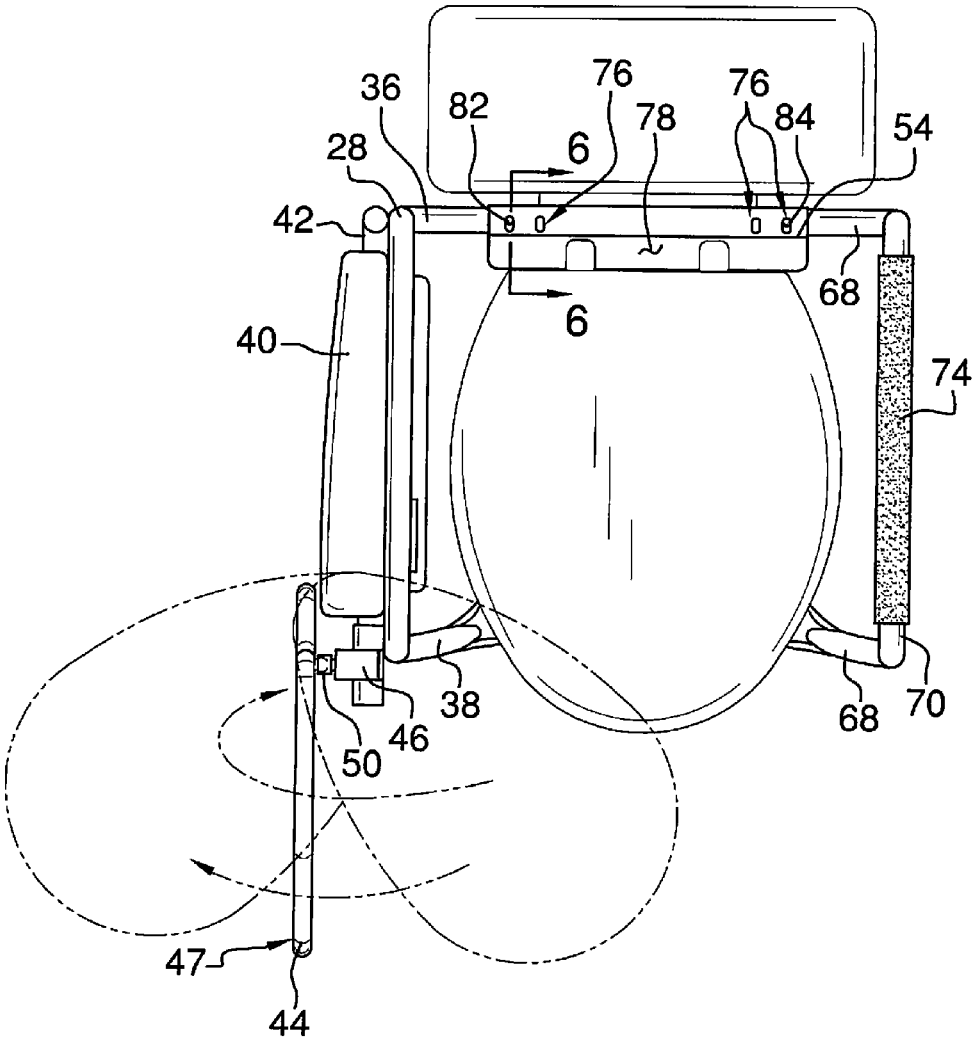
FIG. 2 is a top view of an embodiment of the disclosure.
Figure 3:
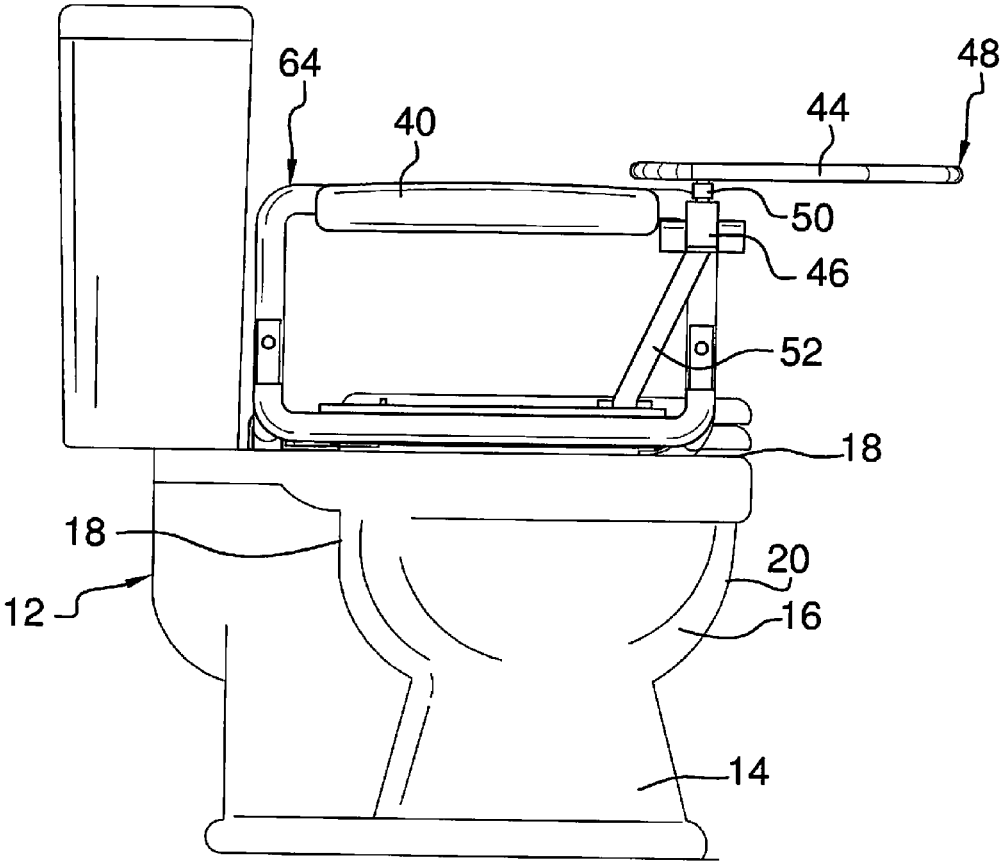
FIG. 3 is a side view of an embodiment of the disclosure.
Figure 4:
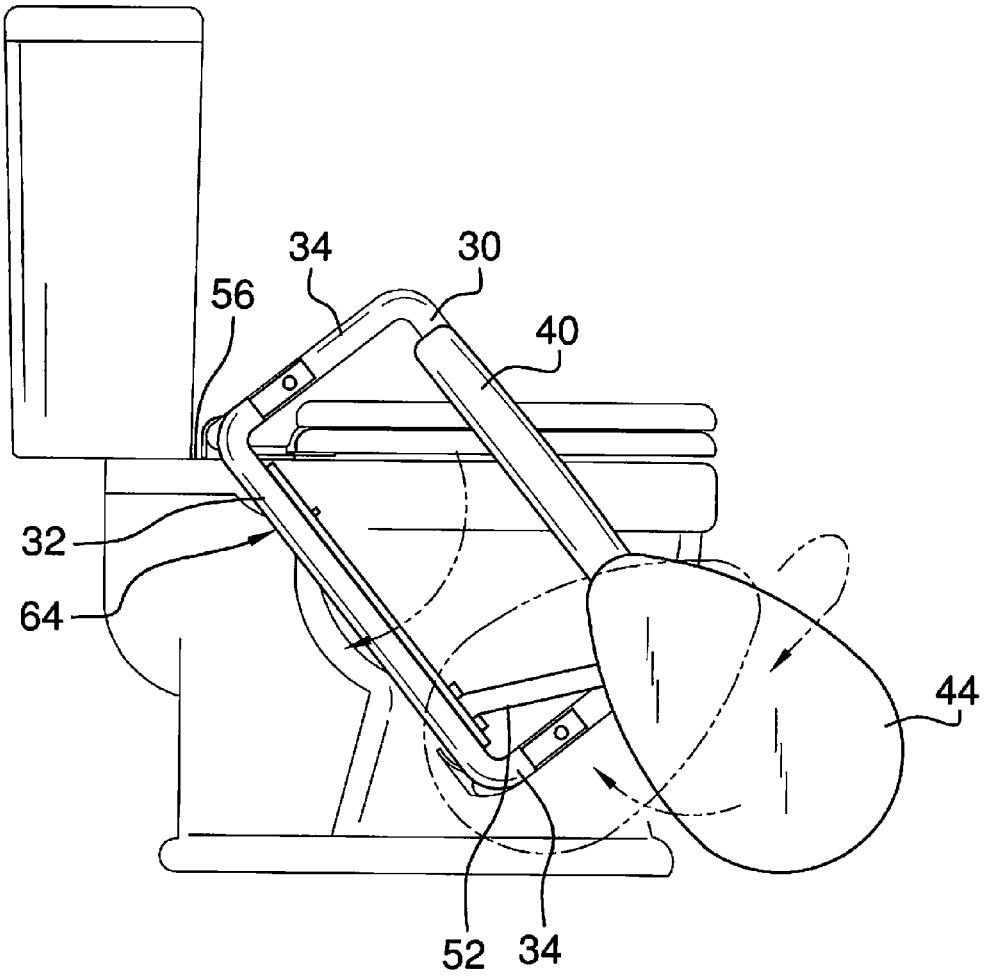
FIG. 4 is a side view similar to FIG. 3, except that FIG. 4 shows the panel being pivoted into the folded position.
Figure 5:
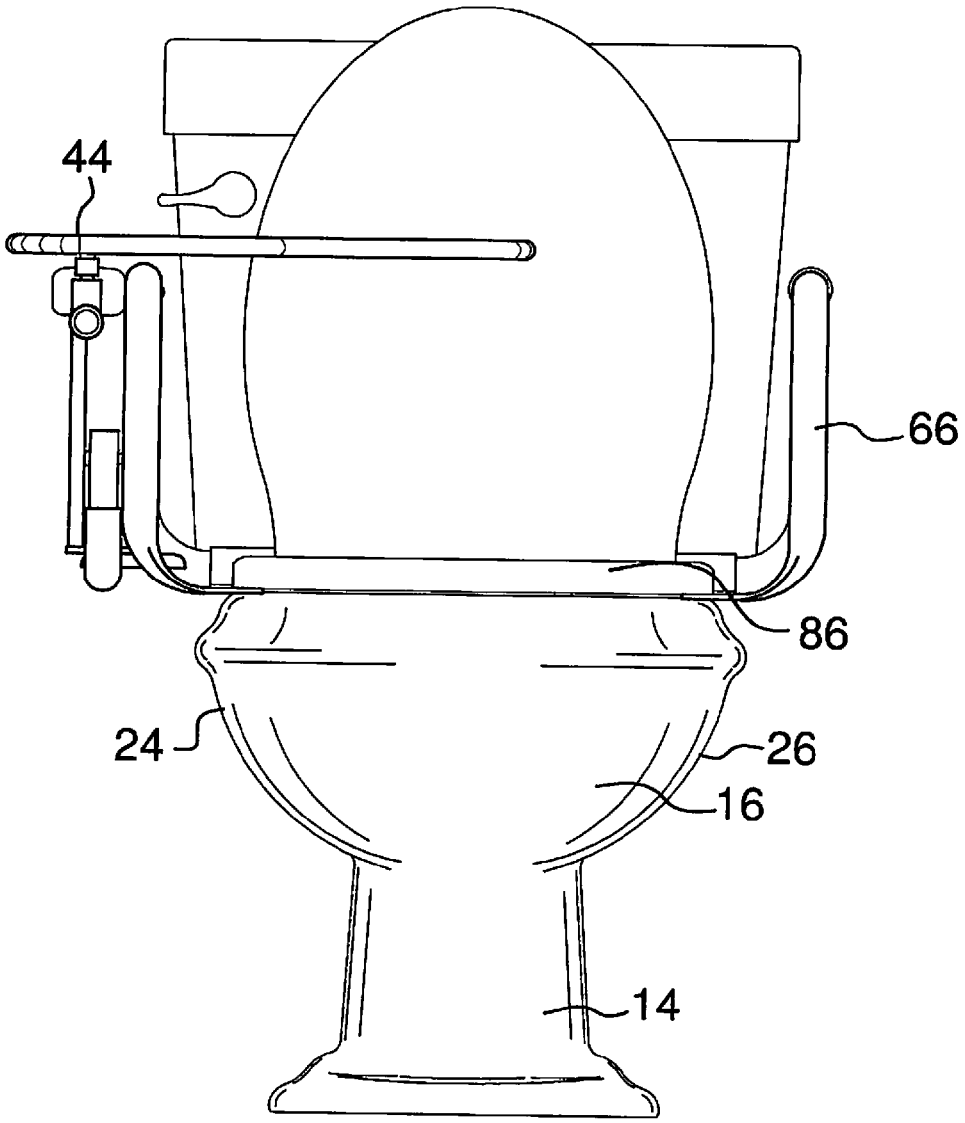
FIG. 5 is a front view of an embodiment of the disclosure.
Figure 6:
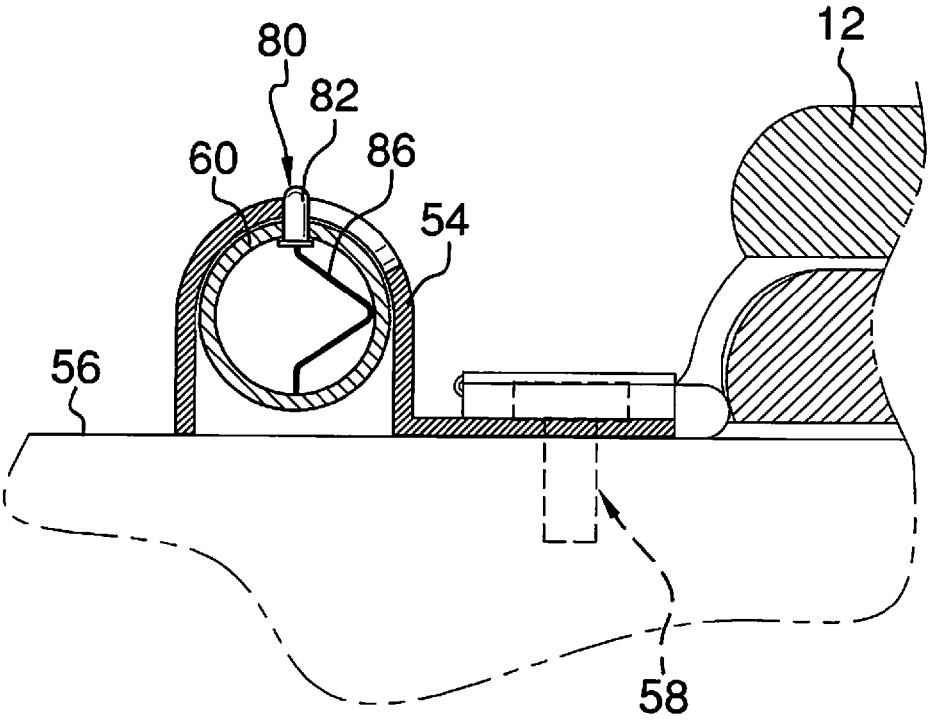
FIG. 6 is a cross-sectional view of an embodiment of the disclosure taken along line 6-6 of FIG. 2.
Figure 7:
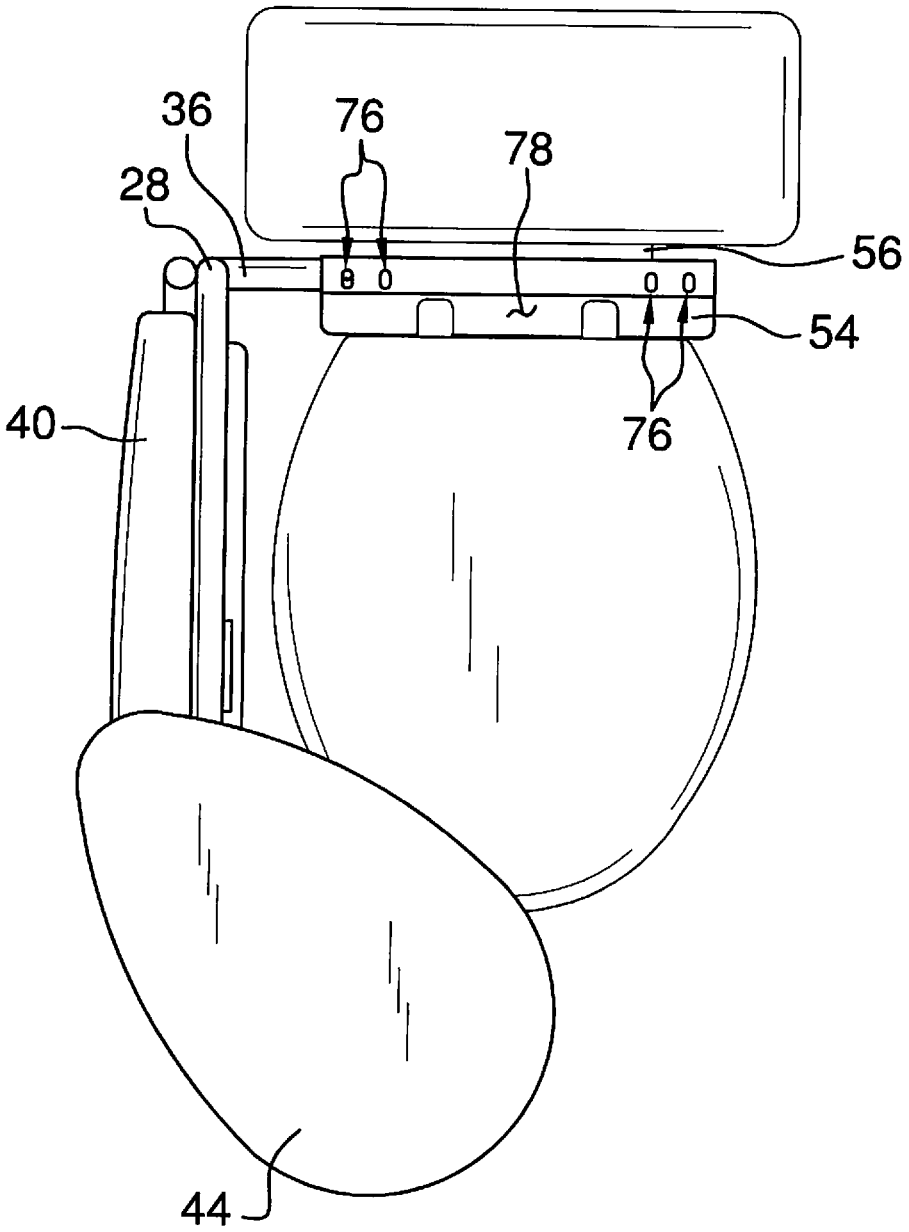
FIG. 7 is a top view of an alternative embodiment of the disclosure.

With reference now to the drawings, and in particular to FIGS. 1 through 7 thereof, a new table device embodying the principles and concepts of an embodiment of the disclosure and generally designated by the reference numeral 10 will be described.

As best illustrated in FIGS. 1 through 7, the toilet stool table assembly 10 generally comprises a conventional toilet 12 having a base 14 and toilet bowl 16 that is attached to and positioned on the base 14. The toilet bowl 16 has an upper edge 18, a front side 20, a rear side 22, a first side 24 and a second side 26. The first 24 and second 26 sides are coupled to and extend between the front 20 and rear 22 sides.

A first arm 28 is coupled to the first side 24 of the toilet bowl 16 and extends along the first side 24 of the toilet bowl 16. The first arm 28 may include an upper tube 30, a lower tube 32 and a pair of side tubes 34 coupled to and extending between the upper 30 and lower 32 tubes. The first arm 28 has a first end 36 spaced from a second end 38. Each of the first 36 and second 38 ends of the first arm 34 is coupled to the first side 24 of the toilet bowl 16. An arm rest 40 is coupled to the first arm 28. In particular, the arm rest 40 may extend along a distal side edge 42 of the first arm 28 with respect to the toilet bowl 16.

A panel 44 is coupled to the first arm 28 wherein the panel 44 defines a desk top. The panel 44 may be oval-shaped. A first panel hinge 46 couples the first arm 28 and the panel 44. The first panel hinge 46 selectively pivots the panel 44 between a folded position 47 and an unfolded position 48. The panel 44 is vertically orientated with respect to the toilet bowl 16 when the panel 44 is in the folded position 46 to allow the panel 44 to be compactly stored while not in use. The panel 44 is horizontally orientated with respect to the upper edge 18 of the toilet bowl 16 when the panel 44 is in the unfolded position 48. A second panel hinge 50 couples the first arm 28 and the panel 44. The second panel hinge comprises a ball and socket hinge configured for rotating the panel 44 in a horizontal direction relative to a ground surface. A brace member 52 is coupled to and extends between the first arm 28 and the first panel hinge 46. In particular, the brace member 52 may extend between the lower tube 32 and the first panel hinge 46.

A covering 54 is coupled to the first arm 28 and to a top 56 of the base 14. A connector 58, or a plurality of connectors 58, each of conventional design, such as screws or the like, couples the covering 54 to the top 56 of the base 14. A covering hinge 60 is coupled to the first arm 28 and is positioned in and extends along a length of the covering 54. The covering hinge 60 pivots the first arm 28 relative to the covering 54 wherein the first arm 28 is pivotable between an extended position 62 and a storage position 64. A longitudinal axis of the first arm 28 is horizontally orientated with respect to the upper edge 18 of the toilet bowl 16 when the first arm 28 is in the extended position 62. An entirety of the first arm 28 may be positioned above the upper edge 18 of the toilet bowl 16 when the first arm 28 is in the extended position 62. The first arm 28 is positioned adjacent to the toilet bowl 16 when the first arm 28 is in the storage position 64.

A second arm 66 is coupled to the second side 26 of the toilet bowl 16 and extends along the second side 26 of the toilet bowl 16. Although the first arm 28 is shown and described as being coupled to the first side 24 of the toilet bowl 16 and the second arm 66 is shown and described as being attached to the second side 26 of the toilet bowl 16, the first arm 28 can alternatively be attached to the second side 26 of the toilet bowl 16 and the second arm 66 can be attached to the first side 24 of the toilet bowl 16 if desired. The second arm 66 includes a pair of side tube sections 68 and a main tube section 70 coupled to and extending between each of the side tube sections 68. Each of the side tube sections 68 has an outer end 72. The outer end 72 of one of the side tube sections 68 is coupled to the covering 54. The outer end 72 of one of the side tube sections 68 is coupled to the second side 26 of the toilet bowl 16. Padding 74 is positioned on the second arm 66. The padding 74 may extend a full circumference around the main tube section 70 of the second arm 66.

A plurality of apertures 76 is positioned in a top surface 78 of the covering 54. A pair of fasteners 80 is coupled to the covering 54. Each of the fasteners 80 is extendable through an associated one of the apertures 76. A first one 82 of the fasteners 80 engages the associated aperture 76 when the first arm 28 is in the extended position 62 wherein the first arm 28 is selectively locked in place relative to the covering 54. A second one 84 of the fasteners 80 couples the second arm 66 to the covering 54. A biasing member 86 is coupled to the covering hinge 60. The biasing member 86 biases the first one 82 of the fasteners 80 outwardly through the associated aperture 76 when the first arm 28 is in the extended position 62. Thus, in particular, the first one 82 of the fasteners 80 may comprise a conventional locking pin.

In use, as stated above and shown in the Figures, while a user is seated on a seat 86 of the toilet 12, the first arm 28 is pivoted to the extended position 62 and the panel 44 is pivoted to the unfolded position 48. Such provides the user with a desk while seated on the seat 86 of the toilet 12. After use, the panel 44 can be swung to the folded position 47 and the first arm 28 can be swung to the storage position 64. This ensures that neither the panel 44 nor the first arm 28 will be a hindrance while not being used.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A toilet stool table assembly comprising:

a toilet having a base and a toilet bowl being attached to and positioned on said base, said toilet bowl having an upper edge, a front side, a rear side, a first side and a second side, said first and second sides being coupled to and extending between said front and rear sides;

a first arm coupled to said first side of said toilet bowl and extending along said first side of said toilet bowl, said first arm having a first end spaced from a second end, each of said first and second ends of said first arm being coupled to said first side of said toilet bowl;

a panel coupled to said first arm;

a covering coupled to said first arm and to a top of said base; and a second arm coupled to said second side of said toilet bowl and extending along said second side of said toilet bowl.

2. The assembly of claim 1, further comprising an arm rest coupled to said first arm.

3. The assembly of claim 2, further comprising said arm rest extending along a distal side edge of said first arm with respect to said toilet bowl.

4. The assembly of claim 1, further comprising said panel being oval-shaped.

5. The assembly of claim 1, further comprising a first panel hinge coupling said first arm and said panel, said first panel hinge selectively pivoting said panel between a folded position and an unfolded position, said panel being vertically orientated with respect to said toilet bowl when said panel is in the folded position, said panel being horizontally orientated with respect to said upper edge of said toilet bowl when said panel is in the unfolded position.

6. A toilet stool table assembly comprising:

a toilet having a base and a toilet bowl being attached to and positioned on said base, said toilet bowl having an upper edge, a front side, a rear side, a first side and a second side, said first and second sides being coupled to and extending between said front and rear sides;

a first arm coupled to said first side of said toilet bowl and extending along said first side of said toilet bowl, said first arm having a first end spaced from a second end, each of said first and second ends of said first arm being coupled to said first side of said toilet bowl;

a panel coupled to said first arm;

a first panel hinge coupling said first arm and said panel, said first panel hinge selectively pivoting said panel between a folded position and an unfolded position, said panel being vertically orientated with respect to said toilet bowl when said panel is in the folded position, said panel being horizontally orientated with respect to said upper edge of said toilet bowl when said panel is in the unfolded position; and a second panel hinge coupling said first arm and said panel, said second panel hinge comprising a ball and socket hinge configured for rotating said panel in a horizontal direction relative to a ground surface.

7. The assembly of claim 5, further comprising a brace member coupled to and extending between said first arm and said first panel hinge.

8. The assembly of claim 5, further comprising:

said first arm including an upper tube, a lower tube and a pair of side tubes coupled to and extending between said upper and lower tubes; and a brace member coupled to and extending between said first arm and said first panel hinge, said brace member extending between said lower tube and said first panel hinge.

9. The assembly of claim 1, further comprising said first arm including an upper tube, a lower tube and a pair of side tubes coupled to and extending between said upper and lower tubes.

10. The assembly of claim 6, further comprising a covering coupled to said first arm and to a top of said base.

11. The assembly of claim 1, further comprising a connector coupling said covering to said top of said base.

12. The assembly of claim 1, further comprising a covering hinge coupled to said first arm and being positioned within said covering, said covering hinge pivoting said first arm relative to said covering wherein said first arm is pivotable between an extended position and a storage position, a longitudinal axis of said first arm being horizontally orientated with respect to said upper edge of said toilet bowl when said first arm is in the extended position, said first arm being positioned adjacent to said toilet bowl when said first arm is in the storage position.

13. The assembly of claim 12, further comprising said first arm being positioned above said upper edge of said toilet bowl when said first arm is in the extended position.

14. The assembly of claim 12, further comprising:

an aperture positioned in a top surface of said covering; and a fastener coupled to said covering, said fastener being extendable through said aperture, said fastener engaging said aperture when said first arm is in the extended position wherein said first arm is selectively locked in place relative to said covering.

15. The assembly of claim 10, further comprising a second arm coupled to said second side of said toilet bowl and extending along said second side of said toilet bowl.

16. The assembly of claim 1, further comprising said second arm including a pair of side tube sections and a main tube section coupled to and extending between each of said side tube sections, each of said side tube sections having an outer end, said outer end of one of said side tube sections being coupled to said covering, said outer end of one of said side tube sections being coupled to said second side of said toilet bowl.

17. The assembly of claim 1, further comprising padding positioned on said second arm.

18. The assembly of claim 1, further comprising:

an aperture positioned in a top surface of said covering;

a second arm coupled to said second side of said toilet bowl and extending along said second side of said toilet bowl; and a fastener coupled to said covering, said fastener being extendable through said aperture, said fastener coupling said second arm to said covering.

19. The assembly of claim 14, further comprising a biasing member coupled to said covering hinge, said biasing member biasing said fastener outwardly through said aperture when said first arm is in the extended position, said fastener comprising a locking pin.

20. A toilet stool table assembly comprising:

a toilet having a base and a toilet bowl being attached to and positioned on said base, said toilet bowl having an upper edge, a front side, a rear side, a first side and a second side, said first and second sides being coupled to and extending between said front and rear sides;

a first arm coupled to said first side of said toilet bowl and extending along said first side of said toilet bowl, said first arm including an upper tube, a lower tube and a pair of side tubes coupled to and extending between said upper and lower tubes, said first arm having a first end spaced from a second end, each of said first and second ends of said first arm being coupled to said first side of said toilet bowl;

an arm rest coupled to said first arm, said arm rest extending along a distal side edge of said first arm with respect to said toilet bowl;

a panel coupled to said first arm, said panel being oval-shaped;

a first panel hinge coupling said first arm and said panel, said first panel hinge selectively pivoting said panel between a folded position and an unfolded position, said panel being vertically orientated with respect to said toilet bowl when said panel is in the folded position, said panel being horizontally orientated with respect to said upper edge of said toilet bowl when said panel is in the unfolded position;

a second panel hinge coupling said first arm and said panel, said second panel hinge comprising a ball and socket hinge configured for rotating said panel in a horizontal direction relative to a ground surface;

a brace member coupled to and extending between said first arm and said first panel hinge, said brace member extending between said lower tube and said first panel hinge;

a covering coupled to said first arm and to a top of said base;

a connector coupling said covering to said top of said base;

a covering hinge coupled to said first arm and being positioned within said covering, said covering hinge pivoting said first arm relative to said covering wherein said first arm is pivotable between an extended position and a storage position, said first arm being horizontally orientated with respect to said upper edge of said toilet bowl when said first arm is in the extended position, said first arm being positioned above said upper edge of said toilet bowl when said first arm is in the extended position, said first arm being positioned adjacent to said toilet bowl when said first arm is in the storage position;

a second arm coupled to said second side of said toilet bowl and extending along said second side of said toilet bowl, said second arm including a pair of side tube sections and a main tube section coupled to and extending between each of said side tube sections, each of said side tube sections having an outer end, said outer end of one of said side tube sections being coupled to said covering, said outer end of one of said side tube sections being coupled to said second side of said toilet bowl;

padding positioned on said second arm, said padding extending a full circumference around said main tube section of said second arm;

a plurality of apertures positioned in a top surface of said covering;

a pair of fasteners coupled to said covering, each of said fasteners being extendable through an associated one of said apertures, a first one of said fasteners engaging said associated aperture when said first arm is in the extended position wherein said first arm is selectively locked in place relative to said covering, a second one of said fasteners coupling said second arm to said covering, said first one of said fasteners comprising a locking pin; and a biasing member coupled to said covering hinge, said biasing member biasing said first one of said fasteners outwardly through said associated aperture when said first arm is in the extended position.

* * * * *